United States Patent [19]

Vaubel et al.

[11] Patent Number: 4,557,315

[45] Date of Patent: Dec. 10, 1985

[54] ADJUSTABLE CONTINUOUS CASTING MOLD ARRANGEMENT

[75] Inventors: Gert Vaubel, Warburg-Welda; Heinz Beier, Paderborn-Schloss Neuhaus, both of Fed. Rep. of Germany

[73] Assignee: Benteler-Werke Aktiengesellschaft, Fed. Rep of Germany

[21] Appl. No.: 620,552

[22] Filed: Jun. 14, 1984

[30] Foreign Application Priority Data

Oct. 1, 1983 [DE] Fed. Rep. of Germany ..... 3335762

[51] Int. Cl.[4] ..... B22D 11/00; B22D 11/04

[52] U.S. Cl. ..... 164/420; 164/436

[58] Field of Search ..... 164/418, 420, 436, 491

[56] References Cited

U.S. PATENT DOCUMENTS 3,717,197 2/1973 Strack et al. ..... 164/436

4,036,284 7/1977 Hoffmann ..... 164/436

4,480,976 11/1984 Vaubel et al. ..... 164/491

FOREIGN PATENT DOCUMENTS 3224065 12/1983 Fed. Rep. of Germany .

*Primary Examiner*—Nicholas P. Godici

*Assistant Examiner*—Richard K. Seidel

*Attorney, Agent, or Firm*—Michael J. Striker

[57] ABSTRACT

A continuous casting mold arrangement for multiple continuous casting installations for producing casting strands of a substantially rectangular cross-section, has a plurality of continuous casting molds each including at least two mold parts displaceable relative to one another in a displacement direction transverse to a strand direction so as to change a strand cross-section, wherein the continuous casting molds are arranged one behind the other in the displacement direction and the respective mold parts of each two neighboring continuous casting molds are connected with one another.

18 Claims, 4 Drawing Figures

ADJUSTABLE CONTINUOUS CASTING MOLD ARRANGEMENT

BACKGROUND OF THE INVENTION

The present invention relates to an adjustable continuous casting mold arrangement, and more particularly for multiple continuous casting installations for manufacturing casting strands of a substantially rectangular cross-section.

Continuous mold arrangements of the above-mentioned general type are known in the art. One of such continuous casting mold arrangements includes a plurality of molds each of which is composed of at least two mold parts which are displaceable relative to one another in a displacement direction transverse to a strand direction, so as to change a strand cross-section. Such a continuous casting mold arrangement is disclosed, for example in the patent application of the inventor Ser. No. P 3,224,065. This continuous casting mold arrangement provides for satisfactory results. The specific feature of the above-mentioned continuous casting mold arrangement is that because of the special contour of both mold parts, multiple continuous casting molds such as twin molds, triple molds and the like can be formed. In one of the embodiments disclosed in this German patent application, the known continuous casting mold arrangement includes two mold parts with an F-formed contour which limitedly engage with one another. For adjusting of this twin mold both mold parts are displaced relative to one another, so as to increase the cross-section of one mold and simultaneously reduce the crosssection of the other mold.

SUMMARY OF THE INVENTION

It is an object of the present invention to provide a continuous casting mold arrangement which is improved as compared with the known continuous casting mold arrangements.

More particularly, it is an object of the present invention to provide a continuous casting mold arrangement which maintains the advantages of the known continuous casting mold arrangements, and at the same time, can provide for a greater number of different mold cross-sections.

In keeping with these objects and with others which will become apparent hereinafter, one feature of the present invention resides, briefly stated, in a continuous casting mold arrangement in which several continuous casting molds adjustable by displacement of their mold parts are arranged one behind the other in a displacement direction, and the respective mold parts of each two neighboring continuous casting molds are coupled with one another.

When for example in the arrangement in accordance with the prior art one mold cross-section is increased by the same value by which the other mold cross-section is reduced, the inventive arrangement provides for the advantage in that the individual mold cross-sections can be increased or reduced independent of one another in different values. All mold cross-sections can be either reduced simultaneously by the different value or increased simultaneously by different value, and at the same time they can be partially increased or reduced.

With the inventive adjustment of the individual mold cross-sections the invention provides in accordance with a special feature the possibility to increase and/or to reduce all mold parts by a same value. For this purpose a displacement drive is connected with one continuous casting mold for example with an outer continuous casting mold as seen in the displacement direction, to simultaneously adjust all continuous casting molds by the same value. This displacement drive displaces the mold parts of each continuous casting mold by the same value. When the individual mold cross-sections are adjusted to a predetermined value, it is possible because of this feature to change the cross-section by an equally great amount with a high precision and by simple means.

In accordance with the present invention the continuous casting mold arrangement makes possible to use different mold types, and these different mold types can also be combined in the same continuous casting mold arrangement. There is a possibility to form at least one continuous casting mold of a pair of L-shaped mold parts. There is another possibility to form at least one continuous casting mold of a pair of mold parts formed congruent and comb shaped. Particularly, such a comb shaped mold part is formed of an F-shaped mold part. A further possibility is to form a double mold with at least one mold part with a T-shaped contour and one mold part with a U-shaped contour. These different continuous casting mold types can be used combined in the same continuous casting mold arrangement.

In accordance with a further embodiment of the present invention which is especially simple to realize, the respective mold parts of the neighboring continuous casting molds are connected with one another by a threaded adjusting device which is connected with these parts, for example, articulately.

In accordance with a special embodiment of the invention the threaded adjusting device includes a threaded rod extending parallel to the displacement direction, a sleeve seating on the threaded rod with its inner thread and having an outer thread, and a threaded spindle or a threaded rack engaging with the outer thread of the sleeve. The pivotal connection of the threaded rod with the respective mold part can be easily made by a fork or a cardan joint mounted on the mold part, so that the threaded rod engages with the same. The outer thread of the sleeve extends in some cases over a relatively great length portion of the sleeve, so that the individual adjustment of the individual continuous casting molds is also possible when all continuous casting molds are displaced simultaneously by the displacement In accordance with a special embodiment of the invention, the threaded adjusting device is formed so that during individual adjustment of a continuous casting mold one of the continuous casting molds coupled with the threaded adjusting device is immovable whereas all the other continuous casting molds move.

By actuation of the threaded adjusting device, also two neighboring continuous casting molds can be displaced simultaneously and namely so that the threaded adjusting device is formed as double-acting device particularly provided with threads of opposite directions.

The adjustment of the mold cross-section is advantageously performed so that both mold parts of each continuous casting mold are displaced relative to one another in opposite directions. In accordance with the present invention both respective mold parts of the neighboring continuous casting mold are coupled with one another in an adjustable manner.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
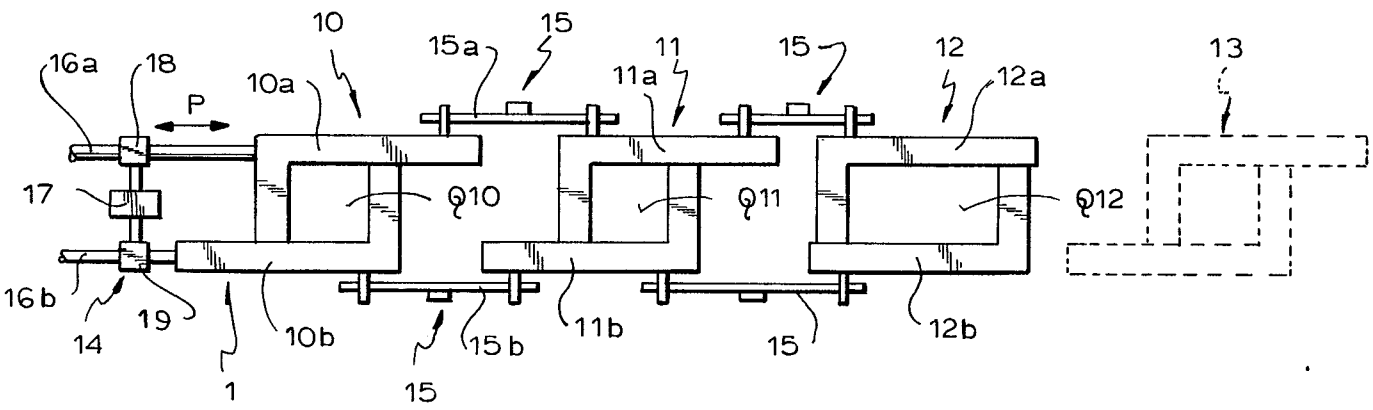
FIG. 1 is a schematic plan view of an adjustable continuous casting mold arrangement in accordance with the present invention.

FIG. 1 shows a continuous casting mold arrangement 1 which has a plurality of continuous casting molds 10, 11 and 12 arranged one after the other. The arrangement can be expanded by adding further continuous casting molds 13 as shown in broken lines in FIG. 1. Each continuous casting mold 10, 11 and 12 is composed of two L-shaped mold parts 10*a* and 10*b*, 11*a* and 11*b*, 12*a* and 12*b*, respectively.

Casting strands of rectangular cross-section can be manufactured with the continuous casting mold arrangement 1 in a multiple strand casting installation. These cross-sections are shown in FIG. 1 and identified with reference $Q_{10}$ for the continuous casting mold 10, $Q_{11}$ for the continuous casting mold 11, and $Q_{12}$ for the continuous casting mold 12.

The cross-sections of the molds corresponding to the cross-sections of the strands $Q_{10}$, $Q_{11}$ and $Q_{12}$ can be individually adjusted with the aid of threaded adjusting devices 15. Each of these devices which are substantially identical is not shown in detail and composed substantially of a threaded spindle provided at its both ends with threads of opposite direction. These oppositely directed threads engage each in a respective inner thread which is formed in a bar attached to a respective mold part. As shown in FIG. 1, every two respective mold parts of the neighboring continuous casting molds 10, 11 or 11, 12 are coupled with one another via the threaded adjusting devices 15.

The mold parts rest on sliding guides which are not shown in the drawing. The sliding guides can in some cases be curved so as to provide for a conicity of the molds normal to the plane of the drawing.

Spindles 15*a* and 15*b* are fixed on the mold parts 10*a* and 10*b* of the continuous casting mold 10 and are displaceable to the left and to the right in the direction of a double arrow P by a motor 17 via transmissions 18 or 19.

The adjustment of the different mold cross-sections $Q_{10}$, $Q_{11}$ and $Q_{12}$ of the continuous casting mold arrangement 1 is performed in the following manner:

When one assumes that with the immovable motor 17 both spindles 16*a* and 16*b* are immovable, the cross-section $Q_{10}$ remains unchanged, regardless of the actuation of the threaded adjusting device 15 connected with the continuous mold 10. When the threaded adjusting device 15 coupled with the mold part 10*a* is actuated in the sense of an expansion, the mold part 11*a* displaces to the right in FIG. 1, whereas with the non-actuated threaded adjusting device connected with the mold part 10*b*, the mold part 11*b* remains immovable. When both adjusting devices located between the continuous casting molds 11 and 12 are not actuated, the mold part 12*a* displaces by a corresponding distance because of the displacement of the mold part 11*a*. The cross-section $Q_{11}$ can be adjusted in that only the adjusting device 15 located above in FIG. 1 between the continuous casting molds 10 and 11 is adjusted. Similarly, the cross-section $Q_{12}$ can be adjusted in that only the adjusting device 15 located above in FIG. 1 between the continuous casting molds 11 and 12 can be adjusted.

From the above presented description it is understood that both adjusting devices 15 shown below in FIG. 1 between the continuous casting molds 10 and 11 or 11 and 12, can be replaced by a rigid connection. Advantageously, these both devices can be however formed as threaded adjusting devices, so that an optimal variation region for the different mold cross-sections can be available.

In deviation from the embodiment shown in FIG. 1, it is also possible to form the displacement drive 14 so that with the immovable motor 17 both mold parts 10*a* and 10*b* can be moved for example in that one or both threaded adjusting devices located between the continuous casting molds 10 and 11 as well as 11 and 12 can be actuated.

Figure 2:
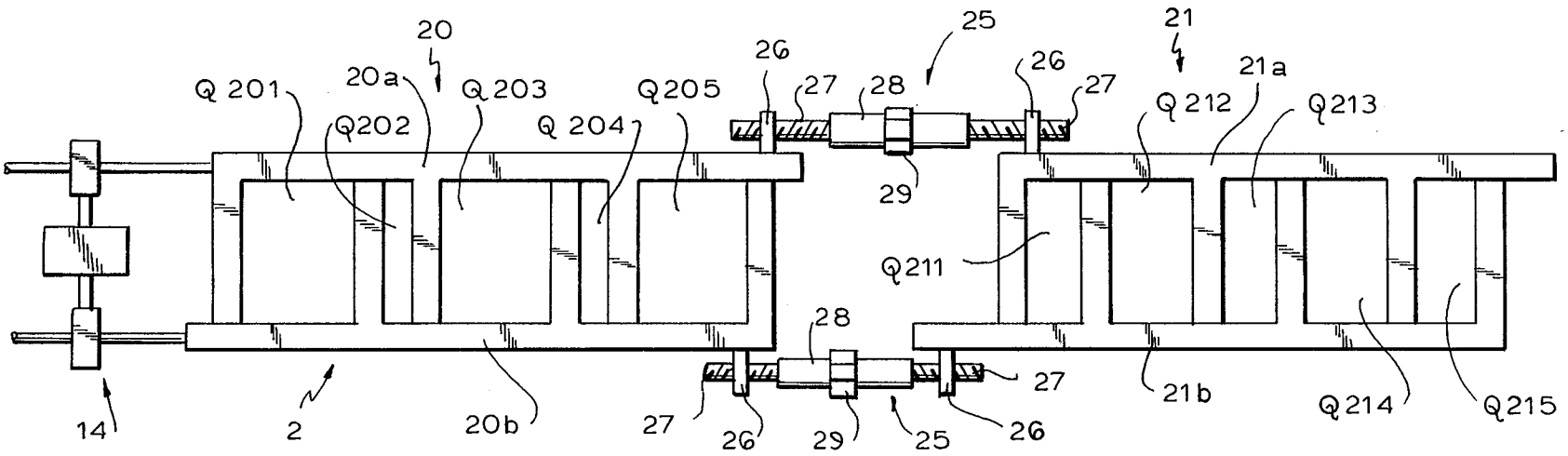
FIG. 2 is a schematic plan view of the adjustable continuous casting mold arrangement in accordance with another embodiment.

FIG. 2 shows a further embodiment of the invention. The adjustable continuous casting mold arrangement 2 includes the above-mentioned displacement drive 14, a continuous casting mold 20 connected therewith, and a continuous casting mold 21 connected with the continuous casting mold 20 via a threaded adjusting device 25.

The continuous casting mold 20 is composed of two congruent comb-like mold parts 20*a* and 20*b* which form five different mold cross-sections $Q_{201}$ to $Q_{205}$. The continuous casting mold 21 is composed of mold parts 21*a* and 21*b* which are similar to the mold parts 20*a* and 20*b* and form mold crosssections $Q_{211}$ to $Q_{215}$.

Both threaded adjusting devices 25 have identical constructions. Lugs 26 are welded on the other sides of the mold parts 20*a*, 20*b*, 21*a*, and 21*b* as shown in FIG. 2. Threaded rods 27 are supported in the lugs 26 turnable at all sides and axially non-displaceable. The other ends of the threaded rods 27 extend into a sleeve 28 which is provided with two inner threads having opposite directions, and a nut 29 sits on the sleeve 28. When the nut 29 is turned in one direction, the threaded rods 27 is pulled into the sleeve and thereby the connected mold parts 20*a* and 21*a* or 20*b* and 21*b* are pulled toward one another. When the nut 29 is turned in another direction, the above-mentioned mold parts are pressed apart from one another.

It can be seen from FIG. 2 that both continuous casting molds can be adjusted in a similar manner as described above for the continuous casting mold arrangement 1. The threaded adjusting devices 28 shown in FIG. 2 can be actuated by the hand.

In the above described embodiments of the invention the individual continuous casting molds of the arrangement are formed identically. Instead of the above described mold parts with L-shaped or comb-shaped contour, also mold parts of other contours can be used, for example with an F-shaped contour, as well as the continuous casting molds in which one mold part has a T-shaped contour and another mold part has a U-shaped contour, as described in the abovementioned patent application No. P 3,224,065.

In accordance with a further embodiment of the present invention different continuous mold parts can be combined in any manner to form a respective continuous casting mold arrangement.

Figure 3:
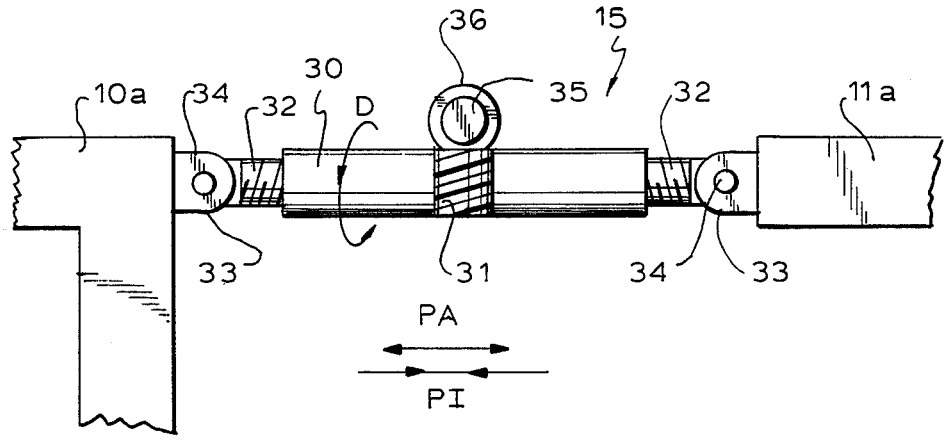
FIG. 3 is a plan view of a threaded adjusting device between two respective mold parts of two neighboring continuous casting molds.

FIG. 3 shows a threaded adjusting device as used, for example, in the continuous casting mold arrangement 1. This threaded adjusting device 15 is not actuated by hand, but instead is actuated for example via an electric motor. The threaded adjusting device 15 shown in FIG. 3 includes a sleeve 30 which is provided with inner threads in its both end portions and with an outer thread 31 over a part of its length. The sleeve 30 receives in its inner threads and its both ends a respective one of a threaded rod 32. The outer ends of both threaded rods 32 are articulately connected via a pivot pin 34 with a fork 33 which is welded on a mold part. Both mold parts 10*a* and 11*a* are shown in FIG. 3.

A worm wheel 36 formed on a threaded spindle 35 engages with the outer thread 31 provided on the sleeve 30. When the worm wheel 36 is turned so that the sleeve 30 rotates in the direction of the arrow D, both threaded rods 32 are pulled together in direction of the double arrow Pl, so that both mold parts 10*a* and 11*a* move toward one another. When the sleeve 30 rotates in the direction opposite to the arrow D, both mold parts 10*a* and 11*a* move away of one another in the direction of the double arrow PA.

Figure 4:
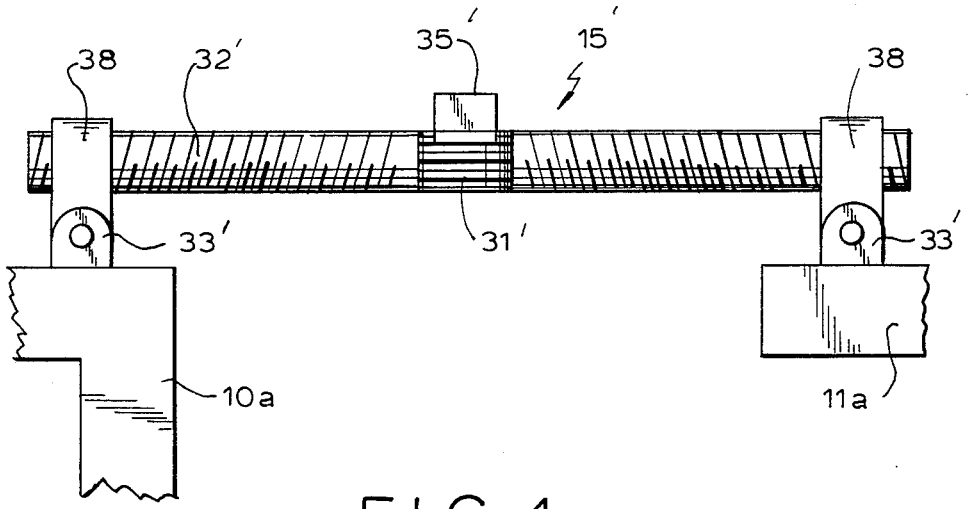
FIG. 4 is a view showing a further embodiment of the arrangement shown in FIG. 3.

FIG. 4 shows a different embodiment of a threaded adjusting device 15'. In contrast to the embodiment of FIG. 3, lugs 33' are located here on the outer side of the mold parts, or in other words, offset by 90° relative to the displacement direction of the mold parts. A continuous threaded rod 32' is provided. It has at its both sides outer thread portions with threads of opposite directions, and in its center is formed as a toothed wheel 31 engaging with a toothed rack 35'. The toothed rack moves normally to the plane of the drawing. In correspondence with the movement of the toothed rack, the threaded rod 32' moves in one or another direction. The threaded portions formed on both ends of the threaded rod 32' and having threads of opposite directions, engage in a support 38 with an inner thread. The support 38 is articulately connected with the lugs 33'. When the threaded rod 32' is moved, both mold parts 10*a* and 11*a* are either pulled toward one another or spread from one another, depending upon the direction of rotation of the threaded rack.

In deviation from the above described embodiments shown in FIGS. 3 and 4, the forked support 33 and 33' can be connected by a cardan joint. The pivotal connection between the threaded rods and the mold parts is then required when the mold parts move not rectilinearly, but instead over a somewhat curved path, so as to change the conicity of the mold crosssection as mentioned above.

In accordance with a further deviation from the above described embodiments, in FIG. 1 for example only one threaded rod 32 can be provided, whereas the sleeve 30 can be rotatably supported for example on the mold part 10*a* or the mold part 11*a*. A corresponding deviation of the embodiment shown in FIG. 4 is also possible. It is to be understood that the threaded adjusting device 25 shown in FIG. 2 can be provided with an adjusting thread only at its one side.

It will be understood that each of the elements described above, or two or more together, may also find a useful application in other types of constructions differing from the types described above.

While the invention has been illustrated and described as embodied in an adjustable continuous casting mold arrangement it is not intended to be limited to the details shown, since various modifications and structural changes may be made without departing in any way from the spirit of the present invention.

without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A continuous casting mold arrangement for multiple continuous casting installations for producing casting strands of a substantially rectangular cross-section, comprising a plurality of continuous casting molds each having at least two mold parts which are displaceable relative to one another for strand cross-section change in a displacement direction substantially transverse to a strand direction, said continuous casting molds being arranged one behind the other in said displacement direction, and the respective mold parts of each two neighboring ones of said continuous casting molds being connected with one another.

2. A continuous casting mold arrangement as defined in claim 1; and further comprising a displacement drive provided for simultaneous displacement of like mold parts of all continuous casting molds by an equal distance relative to one another and arranged on one of said continuous casting molds.

3. A continuous casting mold arrangement as defined in claim 2, wherein said continuous casting molds include an outer continuous casting mold as considered in said displacement direction, said displacement drive being connected with said outer continuous casting mold.

4. A continuous casting mold arrangement as defined in claim 1, wherein said mold parts of at least one of said continuous casting molds includes a pair of L-shaped mold parts.

5. A continuous casting mold arrangement as defined in claim 1, wherein said mold parts of at least one of said continuous casting molds includes a pair of mold parts having a congruent comb-shaped contour and limitedly engaging with one another.

6. A continuous casting mold arrangement as defined in claim 5, wherein said mold parts of said pair are F-shaped.

7. A continuous casting mold arrangement as defined in claim 1, wherein at least one of said continuous casting molds is formed as a twin mold and its mold parts include one mold part with T-shaped contour, and one mold part with a U-shaped contour.

8. A continuous casting mold arrangement as defined in claim 1, wherein said plurality of continuous casting molds includes continuous casting molds of different types.

9. A continuous casting mold arrangement as defined in claim 1; and further comprising a threaded adjusting device connecting said respective mold parts of two neighboring continuous casting molds.

10. A continuous casting mold arrangement as defined in claim 9, wherein said threaded adjusting device is articulately connected with said respective mold parts.

11. A continuous casting mold arrangement as defined in claim 9, wherein said threaded adjusting device includes a threaded rod extending parallel to said displacement direction, a sleeve having an inner thread with which it is seated on said threaded rod and also having an outer thread, and a threaded member engaging with said outer thread of said sleeve.

12. A continuous casting mold arrangement as defined in claim 11, wherein said threaded member is formed as a threaded spindle.

13. A continuous casting mold arrangement as defined in claim 11, wherein said threaded member is formed as a toothed rack.

14. A continuous casting mold arrangement as defined in claim 9, wherein said threaded adjusting device has a threaded rod extending parallel to said displacement direction and having two opposite outer threads, a toothed wheel engaging with said toothed rack, and supports provided on said mold parts and having inner threads cooperating with said outer threads of said toothed rack.

15. A continuous casting mold arrangement as defined in claim 14, wherein said threaded adjusting device is formed so that during individual adjustment of one continuous casting mold one of the continuous casting molds connected with said threaded adjusting device remains immovable and only the other continuous casting mold is moved.

16. A continuous casting mold arrangement as defined in claim 9, wherein said threaded adjusting device is formed as a device acting in two directions.

17. A continuous casting mold arrangement as defined in claim 16, wherein said threaded adjusting device is provided with two threads having opposite directions.

18. A continuous casting mold arrangement as defined in claim 1, wherein both respective mold parts of two neighboring continuous casting molds are adjustably connected with one another.

* * * * *